United States Patent [19]

Miskin et al.

[11] Patent Number: 5,056,625

[45] Date of Patent: Oct. 15, 1991

[54] LOW PROFILE BASE FOR A STORAGE AND RETRIEVAL MACHINE

[75] Inventors: Stephen N. Miskin, Sandy, Utah; Kurt M. Lloyd, Pewaukee, Wis.

[73] Assignee: Harnischfeger Engineers, Inc., Brookfield, Wis.

[21] Appl. No.: 411,295

[22] Filed: Sep. 22, 1989

[51] Int. Cl.[5] ..... B66B 9/20

[52] U.S. Cl. ..... 187/9 R; 414/279; 104/242

[58] Field of Search ..... 187/9 R, 9 E; 414/281, 414/282, 283, 279; 104/242, 243, 119; 105/141

[56] References Cited

U.S. PATENT DOCUMENTS

| | | | |
|---|---|---|---|
| 1,546,620 | 7/1925 | Church | 104/242 |
| 1,682,974 | 9/1928 | Lukens | 104/242 |
| 2,800,861 | 7/1957 | Michalski | 104/242 |
| 4,529,066 | 7/1985 | Wieschel | 414/279 |

FOREIGN PATENT DOCUMENTS

| | | | |
|---|---|---|---|
| 90546 | 10/1957 | Norway | 104/242 |
| 9123 | 5/1894 | United Kingdom | 104/242 |

*Primary Examiner*—Robert P. Olszewski
*Assistant Examiner*—Kenneth Noland
*Attorney, Agent, or Firm*—Richard C. Ruppin

[57] ABSTRACT

A base for a storage and retrieval machine is disclosed in which the frame of the base comprises a pair of spaced apart frame members having a length generally parallel to the rail upon which the base travels and extending a portion of the length of the base. The frame members are positioned straddling the rail with the rail projecting upward into the space between the frame members. A mast is mounted on the base and supports a vertically movable carriage means for carrying objects to and from overhead locations. The pair of frame members may comprise a pair of L-shaped members each having a downwardly projecting upper wall spaced apart from the upper wall of the other L-shaped member and a lower wall projecting away from the lower wall of the other L-shaped member in a direction laterally of the length of the base. The base includes first and second trucks located at opposite ends of the pair of L-shaped members. A wheel is rotatably mounted on each truck and both wheels engage the rail for supporting the storage and retrieval machine as it travels along the rail. The trucks have a height sufficient to support the wheels, however, the L-shaped member pair are positioned at a lower height than the height of the first and second trucks to permit the low height profile of the base. An anti-tip bracket is affixed to a foundation adjacent the path of travel of the base, typically at the end of an aisle in which the rail is located. A lower wall of one of the L-shaped sections engages the anti-tip bracket to hold the storage and retrieval machine from tipping.

6 Claims, 5 Drawing Sheets

4
66
64
62

60
58
76a
72
70
78
106
132
120
134
102
110
100
10
2

LOW PROFILE BASE FOR A STORAGE AND RETRIEVAL MACHINE

FIELD OF THE INVENTION

This invention relates to a base for a storage and retrieval machine which is travelable along a rail and, in particular, to such a base which utilizes a frame having a plate structure permitting a low profile of the base on the rail.

BACKGROUND OF THE INVENTION

Storage and retrieval machines are commonly used in material and inventory storage facilities for storing items in and retrieving the items from the facilities. Typical of such facilities are warehouses having storage racks of substantial height and width arranged along aisles in which the storage and retrieval machines travel on rails to various rack locations. Due to the need to have a highly efficient storage facility, the storage racks are designed to provide a maximum number of rack storage locations.

In another aspect of storage and retrieval machines, the machines are typically self-propelled by electric drive motors and provided with signals from a remote location to direct them to each rack location. Due to the complexity of the storage and retrieval machines and the overall storage and retrieval system, and to typical high duty usage of the machines, occasional breakdowns in the system result in the machines running out of control to an aisle end and impacting a mechanical stopping device. As a result of the impact, the machine may tip and therefore anti-tip devices are usually employed to prevent tipping.

SUMMARY OF THE INVENTION

It is a general object of this invention to provide a base for a storage and retrieval machine traveling on a rail which has a low profile when supported on the rail so that the machine can access storage racks at a relatively low level and thereby make maximum use of the vertical space available. It is a further object of the invention to provide such a low profile base which utilizes the low profile structure as part of an anti-tip means for the storage and retrieval machine.

The objects of the invention are accomplished by providing a base of a storage and retrieval machine with a pair of spaced apart frame members having a length generally parallel to the rail upon which the base travels and which extend a portion of the length of the base. The frame members are positioned straddling the rail with the rail projecting upward into the space between the frame members. As a consequence, the base has a low profile support position on the rail in which the bottom of the base is located below the height of the rail. A mast is mounted on the base and supports a vertically movable carriage means for carrying objects to and from overhead locations.

The pair of frame members may comprise a pair of L-shaped members each having a downwardly projecting upper wall spaced apart from the upper wall of the other L-shaped member and a lower wall projecting away from the lower wall of the other L-shaped member in a direction -laterally of the length of the base. The rail has a height above the foundation on which it is supported and the lower walls of the L-shaped members are positioned at a lower height than that of the rail.

The base includes first and second trucks located at opposite ends of the pair of L-shaped members. A wheel is rotatably mounted on each truck and both wheels engage the rail for supporting the storage and retrieval machine as it travels along the rail. The trucks have a height sufficient to support the wheels, however, the L-shaped member pair are positioned at a lower height than the height of the first and second trucks to permit the low height profile of the base.

An anti-tip bracket is affixed to a foundation adjacent the path of travel of the base, typically at the end of an aisle in which the rail is located, and engages the base to prevent tipping of the storage and retrieval machine in the event of loss of control over the machine which might result in its tipping. A lower wall of one of the L-shaped sections engages the anti-tip bracket to hold the storage and retrieval machine from tipping and thereby the anti-tip holding force is provided directly to the base without requiring any additional devices on the base for engagement with the anti-tip bracket.

BRIEF DESCRIPTION OF THE DRAWINGS

Further objects and advantages will appear when taken in conjunction with the accompanying drawings, in which.

DETAILED DESCRIPTION OF THE INVENTION

Figure 1:
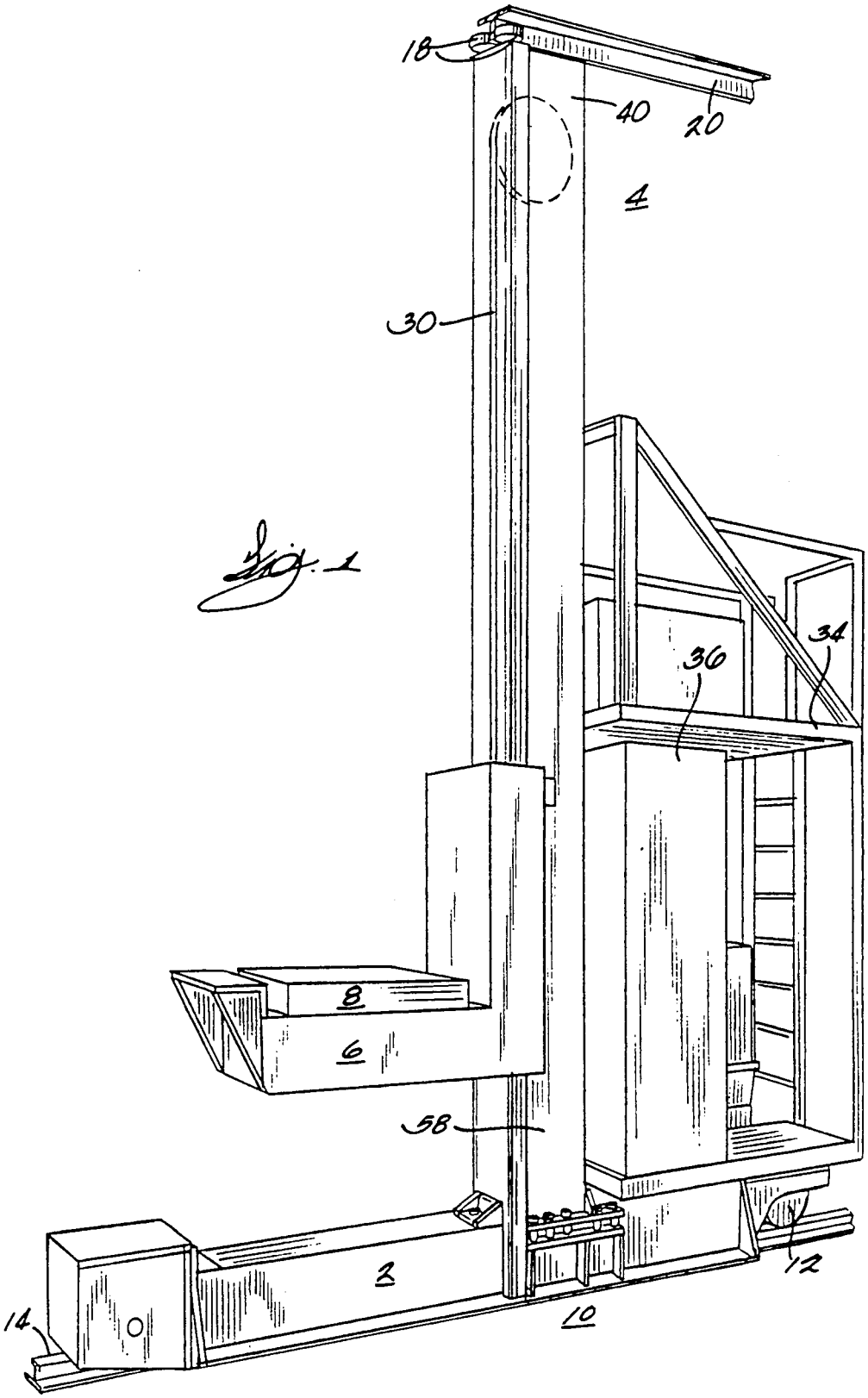
FIG. 1 is a perspective view of a storage and retrieval machine having a low profile base according to the invention.
Figure 2:
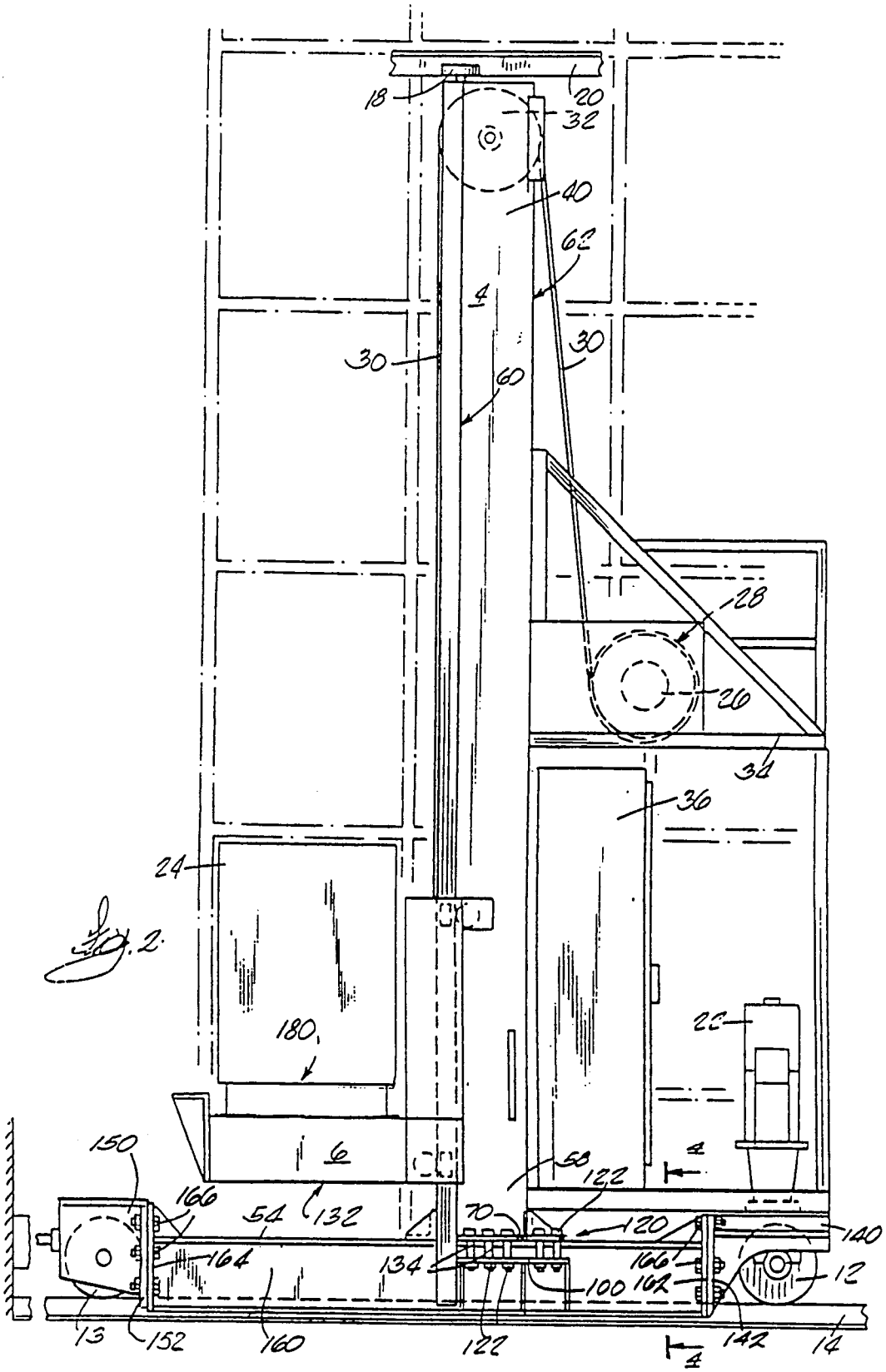
FIG. 2 is a side elevation view of the storage and retrieval machine shown in FIG. 1.
Figure 3:
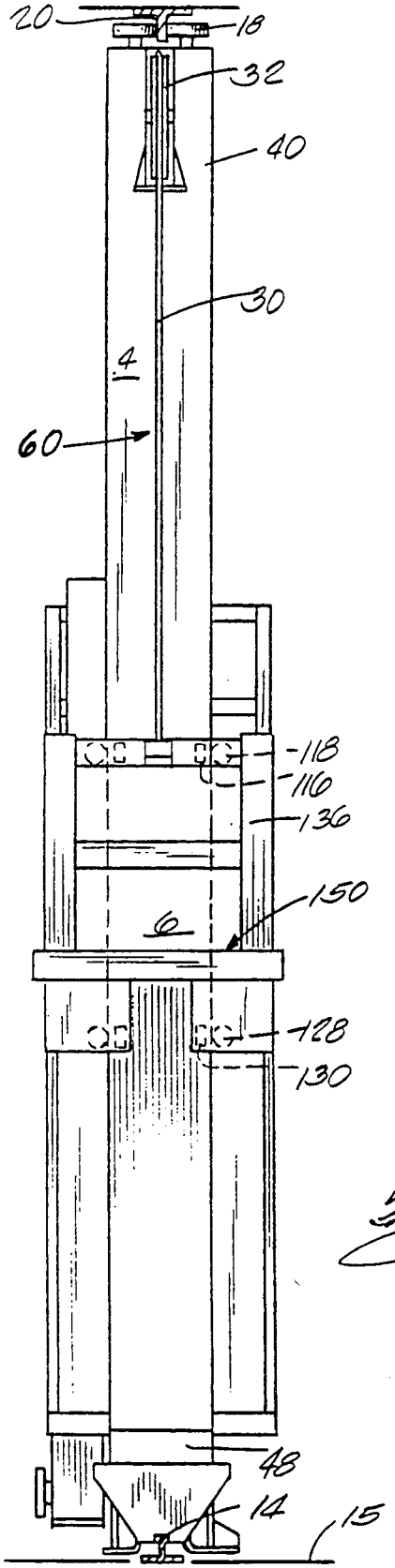
FIG. 3 is a front end elevation view of the storage and retrieval machine shown in FIG. 1.

Referring generally to FIGS. 1—3 of the drawings, a storage and retrieval machine is shown having a base 2, a mast 4 mounted on and extending upwardly from the base 2, a mast connecting structure 10 for connecting the mast to the base, a carriage 6 movable along the length of the mast 4 to selected vertical positions, and a shuttle 8 mounted on the carriage 6. A front wheel 13 and a rear wheel 12 are mounted on the base 2 and roll along a rail 14 supported on a foundation 15 running through an aisle 17 in a storage area such as a warehouse having stacked storage racks 16. Upper guide wheels 18 on the upper end 40 of the mast 4 engage an upper guide rail 20 to guide the storage and retrieval machine along the rail 14 and maintain the machine in an upright position. A motor 22 mounted on the base 2 drives the rear wheel 12 so that the storage and retrieval machine travels along the rail 14 to selected positions in the aisle 17 adjacent to the stacked storage racks 16. At each aisle position of the machine the carriage 6 is driven in vertical directions to a selected one of the storage racks 16 where the shuttle 8 is driven substantially in horizontal directions into a storage rack to deliver or retrieve an object such as box 24 shown in FIG. 2. The carriage 6 is driven by a motor 26 acting through a rope drum assembly 28, both mounted on a frame 34 affixed to the base 2 and the mast 4, and driving a rope 30 connected to the carriage 6 and sheave 32. A control 36 is also mounted on the mast 2 for controlling the operation and movement to selected locations of the mast 2, the carriage 6 and the shuttle 8. Suitable means (not shown) are provided for supplying electrical power to the motors mounted on the base and carriage and control signals to the control 36.

The base 2 comprises two lengthwise parallel spaced apart frame members 42 and 44 each having an L-shaped cross-section and respectively including upper wall plates 46 and 48 and lower plates 50 and 52. The base 2 further comprises a top wall plate 54 which extends along a substantial middle portion of the length of the base 2 and is affixed to the members 42 and 44 by suitable means such as welding. The mast 4 comprises an elongated tube 60 having a rectangular cross section and an additional elongated member 62 affixed along its length to the tube 60 and having sides 64 and 66 and a side 68. In addition to the upper end 40, the mast 4 has a lower end 58 supported by the mast connecting structure 10 and at which the tube 60 is bifurcated and straddles the base 2.

The mast connecting structure 10 includes an upper plate means 70, a lower plate means 100, and connecting means 120 connecting the plate means 70 and 100 together. The upper plate 70 includes an angle iron 72, and angle iron 76, and a plate 78 all affixed to the mast 4. The angle iron 72, the angle iron 76 and the plate 78 each are positioned in engagement with the top wall 54 of the base 2 and together provide an anchoring section of the upper plate means 70 for the mast connecting structure 10. The lower plate means 100 comprises an angle iron 102 positioned between and affixed to the plates 46 and 48 of the base 2, an angle iron 106 also positioned between and affixed to the plates 46 and 48, and connecting bars 110 and 112 respectively affixed to the outer sides of the plates 46 and 48.

The connecting means 120 includes a plurality of nut and bolt means 122 for connecting the upper and lower plate means 70 and 100 and thereby mounting the mast 4 on the base 2. A plurality of support tubes 134 are positioned coaxially on the bolt means 122. The bolt means 122 draws the angle irons 72, 76 and plate 78, against the support of the tubes 134, toward the angle irons 102, 106 and bars 110, 112 upon the tightening of the bolt means to connect the mast to the base.

With reference to FIG. 2, the base 2 includes end trucks 140 and 150 on which the rear wheel 12 and front wheel 13 are respectively rotatably mounted, and a middle section 160 which is comprised of the previously mentioned L-shaped members 42, 44 and top wall 54. The middle section 160 is connected to the end trucks 140 and 150 at flange plates 162, 164 of the section 160 and flange plates 142 and 152 of the respective trucks 140 and 150 by a plurality of bolts 166. Since the end trucks 140 and 150 support the wheels 12 and 13 and desirably enclose the wheels 12 and 13, the trucks 140 and 150 must be positioned above the rail 14 at a height determined by the diameter of the wheels 12 and 13 plus the height of the structure necessary to enclose the wheels. However, the middle section 160 of the base 2 need not meet such requirement and, consequently, can be positioned at a lower height above the foundation 15. Accordingly, the middle section 160 is affixed to the end trucks 140 and 150 by the bolts 166 at a position which recesses the middle section 160 in a downward direction relative to the trucks, as shown in FIG. 2.

Figure 4:
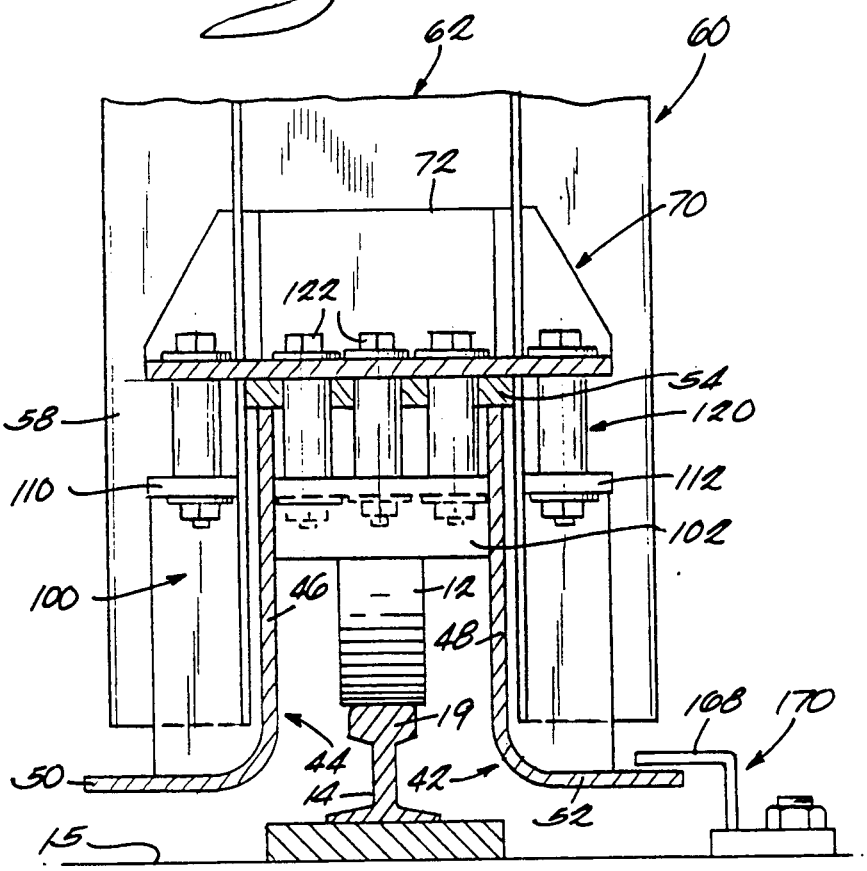
FIG. 4 is an enlarged cross-sectional view, partially broken away, taken along lines 4—4 of FIG. 2.
Figure 5:
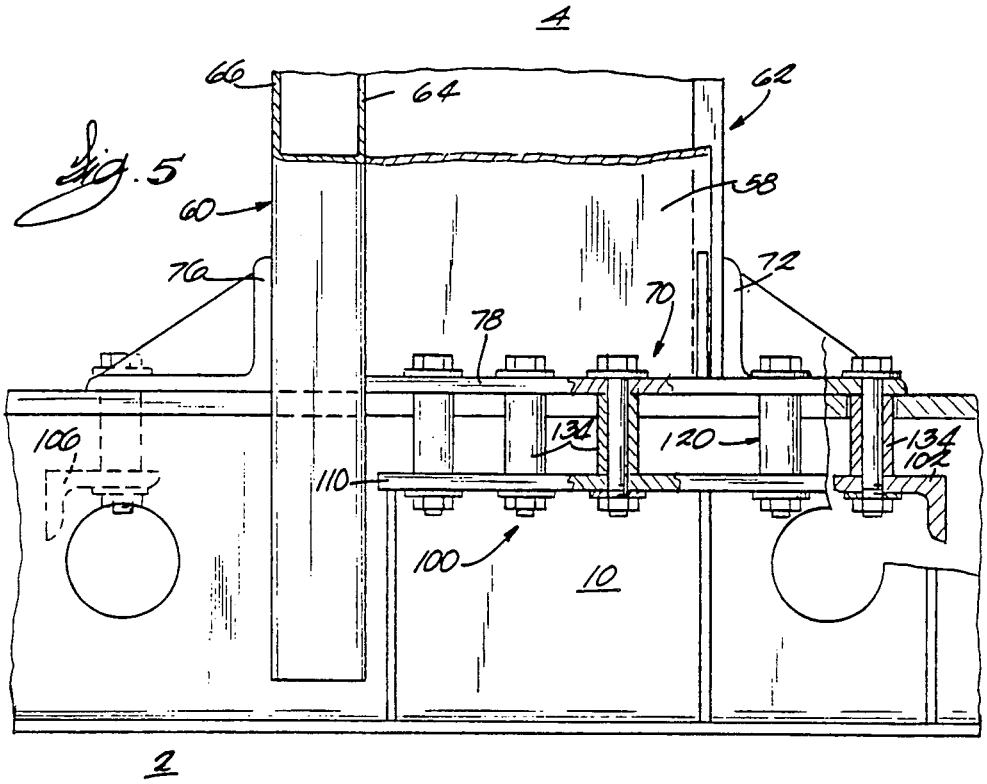
FIG. 5 is a side elevation view partially broken away, illustrating a portion of the base and mast of the storage and retrieval machine shown in FIG. 1.

Referring now to FIG. 4, the base 2 is shown in its normal operating position straddling the rail 14 with the upper wall plates 46 and 48 spaced apart and extending downward opposite the rail 14 and below the height of the rail 14. The rail 14 has a maximum height above the foundation 15 such that the head 19 of the rail is opposite each of the upper wall plates 46 and 48. The lower plates 50 and 52 extend laterally of the length of the rail 14 and away from the rail 14 at a position below the height of the rail. The spacing apart of the L-shaped members 42 and 44 and the extending of the lower plates 50 and 52 away from the rail 14 permit the base 2 to have a low profile position along the middle section 160 of the base. The positioning of the L-shaped members 42 and 44 adjacent to but spaced from each other and bridged by the top wall 54, with the lower plates 50 and 52 extending away from each other, results in a base cross-section in which the plates 50 and 52 contribute to a high overall section modulus of the base 2.

In addition to contributing to the section modulus of the base, one of the lower plates 50 and 52 engages an anti-tip bracket 170 mounted on the foundation 15 adjacent the rail 14 at the end of an aisle. As shown in FIGS. 4 and 6, the anti-tip bracket 170 includes a base member attached to the foundation 15 and a finger 168 under which the lower plate 52 moves when the storage and retrieval machine travels to an end of an aisle. If the machine is subject to tipping forces at the end of the aisle, the tipping will be prevented by the engagement of the anti-tip bracket 170 with the extending lower plate 52.

The L-shaped members 42 and 44 of the base thus permit a low positioning of the base on the rail 14 and at the same time provide a high modulus section for the base. The configuration of the L-shaped members also permits their use in preventing tipping of the crane. The low position of the base close to the foundation 15 enables the bottommost one of the racks 16 to be also positioned very near the foundation 15 to thereby increase the storage height of the stacked racks since the carriage 6 will be able to move to a lower position on the mast 4 above the base to access a lower positioned rack.

It will be understood that the foregoing description of the present invention is for purposes of illustration only and that the apparatus is susceptible to a number of modifications or changes, none of which entail any departure from the spirit and scope of the present invention as defined in the hereto appended claims.

What is claimed is:

1. A base for a storage and retrieval machine travelable along rail and having a must mounted on the base and carriage means movable in vertical directions on the mast for carrying objects to and from overhead locations, the base comprising:

a pair of spaced apart frame members having a length generally parallel to the rail and extending a portion of the length of the base;

the rail having a height;

the frame member pair comprises a pair of L-shaped plate members each having a downwardly projecting upper wall spaced apart from the upper wall of the other L-shaped plate member and a lower wall, each lower wall being positioned at a lower height than that of the rail and projecting away from the lower wall of the other L-shaped plate member in a direction laterally of the length of the frame member pair, the downwardly projecting upper walls and the lower walls forming the L-shape of the L-shaped members; and the frame member pair have a position straddling the rail with the rail projecting upward into the space between the frame member pair whereby the base has a low profile support position on the rail.

2. The base according to claim 1 wherein:

the L-shaped plate member pair has opposite lengthwise ends;

the base includes first and second trucks located at the opposite ends of the L-shaped plate member pair, a wheel being rotatably mounted on each truck and engaging the rail;

the first and second trucks having a height sufficient to support a wheel; and the L-shaped plate member pair is positioned at a height lower than the height of the first and second trucks.

3. The base according to claim 2 wherein:

the first and second trucks each include a frame portion at a height above the wheel supported by each truck; and the L-shaped member pair is positioned at a height lower than the height of said frame portions of each truck.

4. The base according to claim 2 further comprising:

a foundation upon which the rail is supported; and an anti-tip bracket mounted on the foundation at a position such that one of said lower walls will move beneath the bracket whereby tipping of the crane is prevented at the location of the bracket.

5. In a storage and retrieval machine having a base travelable along a rail, a mast mounted on the base, and carriage means movable in vertical directions on the mast for carrying objects to and from overhead locations, the combination comprising:

an anti-tip bracket positioned adjacent to the rail;

the base includes plate frame means for providing base cross-section modulus and engaging the anti-tip bracket to prevent tipping of the storage and retrieval machine; and the plate frame means comprises a top plate and a pair of spaced apart L-shaped plate members, each L-shaped member having an upper wall and a lower wall of the other L-shaped member, the total width of the two lower walls being greater that the space between the L-shaped members, the top plate having a width and bridging the space between the L-spaced plate members, the total width of the lower walls being greater than the width of the top plate.

6. The combination according to claim 5 wherein one of said lower walls is engageable with the anti-tip bracket.

* * * * *